United States Patent [19]

Mihail

[11] Patent Number: 5,012,957

[45] Date of Patent: May 7, 1991

[54] DISPENSER APPARATUS

[75] Inventor: Stavros Mihail, Seattle, Wash.

[73] Assignee: Promation Incorporated, Seattle, Wash.

[21] Appl. No.: 303,540

[22] Filed: Jan. 27, 1989

[51] Int. Cl.[5] ..... B67D 5/08

[52] U.S. Cl. ..... 222/190; 222/61; 222/181; 222/394; 222/425; 222/547; 222/564; 222/642

[58] Field of Search ..... 222/53, 57, 61, 181, 222/185, 380, 394, 396, 639, 642, 650, 564, 146.2, 425, 152, 190, 547; 34/218, 225, 233; 98/55

[56] References Cited

U.S. PATENT DOCUMENTS

| | | | |
|---|---|---|---|
| 2,939,407 | 6/1960 | Keathley, Sr. et al. | 107/15 |
| 2,953,281 | 9/1960 | Johnson | 222/639 X |
| 3,195,786 | 7/1965 | Vogt | 222/394 |
| 3,258,041 | 6/1966 | Lau | 141/10 |
| 3,366,277 | 1/1968 | Barber | 222/642 |
| 3,391,832 | 7/1968 | Weislehner | 222/564 X |
| 3,444,892 | 5/1969 | Doyle et al. | 222/639 X |
| 3,599,832 | 8/1971 | Smith | 222/57 X |
| 4,061,246 | 12/1977 | Miksitz | 222/564 X |
| 4,068,008 | 1/1978 | Orchard | 426/272 |
| 4,136,804 | 1/1979 | Kinzler et al. | 222/564 X |
| 4,199,080 | 4/1980 | Keeney | 222/639 X |
| 4,789,016 | 12/1988 | Mihail | 222/380 X |

FOREIGN PATENT DOCUMENTS

| | | | |
|---|---|---|---|
| 3717348 | 12/1988 | Fed. Rep. of Germany | 222/380 |
| 0033466 | 3/1979 | Japan | 222/61 |
| 8001508 | 10/1981 | Netherlands | 222/61 |

*Primary Examiner*—H. Grant Skaggs
*Assistant Examiner*—Boris Milef
*Attorney, Agent, or Firm*—Christensen, O'Connor, Johnson & Kindness

[57] ABSTRACT

A dispenser apparatus for accurately and repeatedly dispensing predetermined quantities of a flowable material in a continuous rapid succession. The dispenser apparatus includes a durable valve for controlling the flow of the flowable material, particularly granular flowable material. A ventilation system is also provided for preventing ambient moisture from causing the granular flowable material to absorb moisture and clog the passageways of the dispenser apparatus. The dispenser apparatus can be incorporated into conventional container filling systems that are otherwise limited by the speed with which granular flowable materials can be dispensed.

27 Claims, 4 Drawing Sheets

DISPENSER APPARATUS

TECHNICAL FIELD

The present invention relates to apparatuses that are useful for dispensing flowable materials, particularly granular materials that are flowable and must be repeatedly dispensed in small, accurate quantities.

BACKGROUND OF THE INVENTION

In many industries where products are sold in cans or other types of containers, for instance the food industry and the chemical industry, the product often includes components that are flowable materials. For example, in the food industry, granular flowable materials such as salt, sugar, and other spices are necessary ingredients in canned products. In the paint industry, flowable materials in the form of dyes or other property effecting compositions are normally added to the base composition. In both cases, the accuracy with which the flowable material is introduced into the container is a primary concern. With the advent of advanced automation in container filling operations, rather than formulating the product to be packaged in a batch mode by adding individual ingredients to a large tank and then feeding the formulated product to the individual containers, the products are formulated by adding the individual ingredients to the container itself as the container is quickly passed by multiple stations, each corresponding to an individual ingredient in the final product. Generally, the speed at which these automated container filling operations can operate has been limited by the speed at which small accurate amounts of the flowable ingredients can be dispensed into the container.

Previous methods for dispensing flowable materials have suffered from many drawbacks. Primarily, the previous devices that have been designed to operate at speeds consistent with present day container filling operations have not been able to dispense the flowable materials as accurately as is necessary to produce a high quality product having consistent properties. On the other hand, previous dispenser systems that can accurately dispense flowable materials have not been able to keep up with the high-speed operation of advanced container filling operations.

The high speed and accurate dispensing of flowable granular materials presents several added operational problems that have not been overcome by previous dispenser systems. For example, the dispenser apparatus must be capable of maintaining the granular flowable material in a relatively moisture-free environment, particularly when the granular material may absorb the moisture, causing the material to cake and clog the conduits of the dispenser. In addition, many of the granular materials are abrasive and have a deleterious effect on the containers that receive the granular material, particularly when the granular material leaks out of the dispenser onto the exterior of the containers. The abrasiveness of the granular material has been particularly destructive of prior valving mechanisms that are constantly rubbing against the granular material.

In the fish canning industry, metering devices have been used in the past to dispense granular materials such as salt into the containers. The metering device generally includes a rotating disc having a plurality of holes in it. The disc rotates beneath a supply container of salt. As a hole passes beneath the supply container, salt falls out the supply container through the hole and into a container passing below. Normally, the disc is driven by the containers themselves, which requires complicated timing screws and drives to operate the dispenser. These types of devices have been less accurate than desired and also suffer from the problem of moisture contamination of the salt. The accuracy problem has been addressed by using salt in the form of preformed tablets. Unfortunately, such tablets are expensive to manufacture, which contributes to an increased cost of the final product. Another method of introducing salt into the containers is to pass the containers at a constant velocity beneath a constant volume stream of a brine solution. When using this method, the speed of the cans must be carefully controlled. Also, the equipment and containers are constantly being exposed to a corrosive brine solution.

Prior dispensing systems have been less than satisfactory in addressing the operational problems and design considerations described above. It would be desirable to provide a dispenser apparatus for flowable materials, particularly granular flowable materials, that is capable of operating at a high speed with a high degree of accuracy. Not only should the dispenser apparatus be fast and accurate, but is should also be capable of preventing contaminants from the ambient environment, such as moisture, from entering into the flowable material being dispensed by the dispensing appartus. Furthermore, the dispenser apparatus should be made of materials that are highly durable and resistant to chemical and physical degradation by the flowable materials.

SUMMARY OF THE INVENTION

The present invention provides a dispenser apparatus for the high speed and accurate dispensing of flowable materials, particularly granular flowable materials. The apparatus is designed for automated and continuous operation in a container filling system that passes individual containers by the dispenser apparatus formed in accordance with the present invention. The dispenser apparatus is durable and is capable of preventing contaminants in the ambient environment from contaminating the flowable material without the need for large sealed pressure vessels. The dispenser apparatus is simple and easy to use and is easily automated using conventional control systems.

A dispenser apparatus formed in accordance with the present invention includes a chamber having an inlet and an outlet, the inlet being in communication with a source of a flowable material. An expandable valve means cooperates with the outlet of the chamber to intermittently permit the flow of the flowable material from the chamber through the outlet. The expandable value means receives pressurized gas from a source of pressurized gas. The pressurized gas is regulated to repeatedly expand the expandable valve means. Venting of the pressurized gas allows the expandable valve means to contract to a relaxed position. When the valve means is expanded, the flowable material is prevented from flowing out of the chamber, and when the valve means contracts into a relaxed position the flowable material can flow from the chamber.

Other objects, features, and advantages of the present invention will be readily apparent from the following description of certain preferred embodiments thereof, taken in conjunction with the accompanying drawings. It is understood that variations and modifications may be effected without departing from the spirit and scope of the novel concepts of the disclosure.

DETAILED DESCRIPTION OF THE INVENTION

Figures 1, 2, 3, 4:
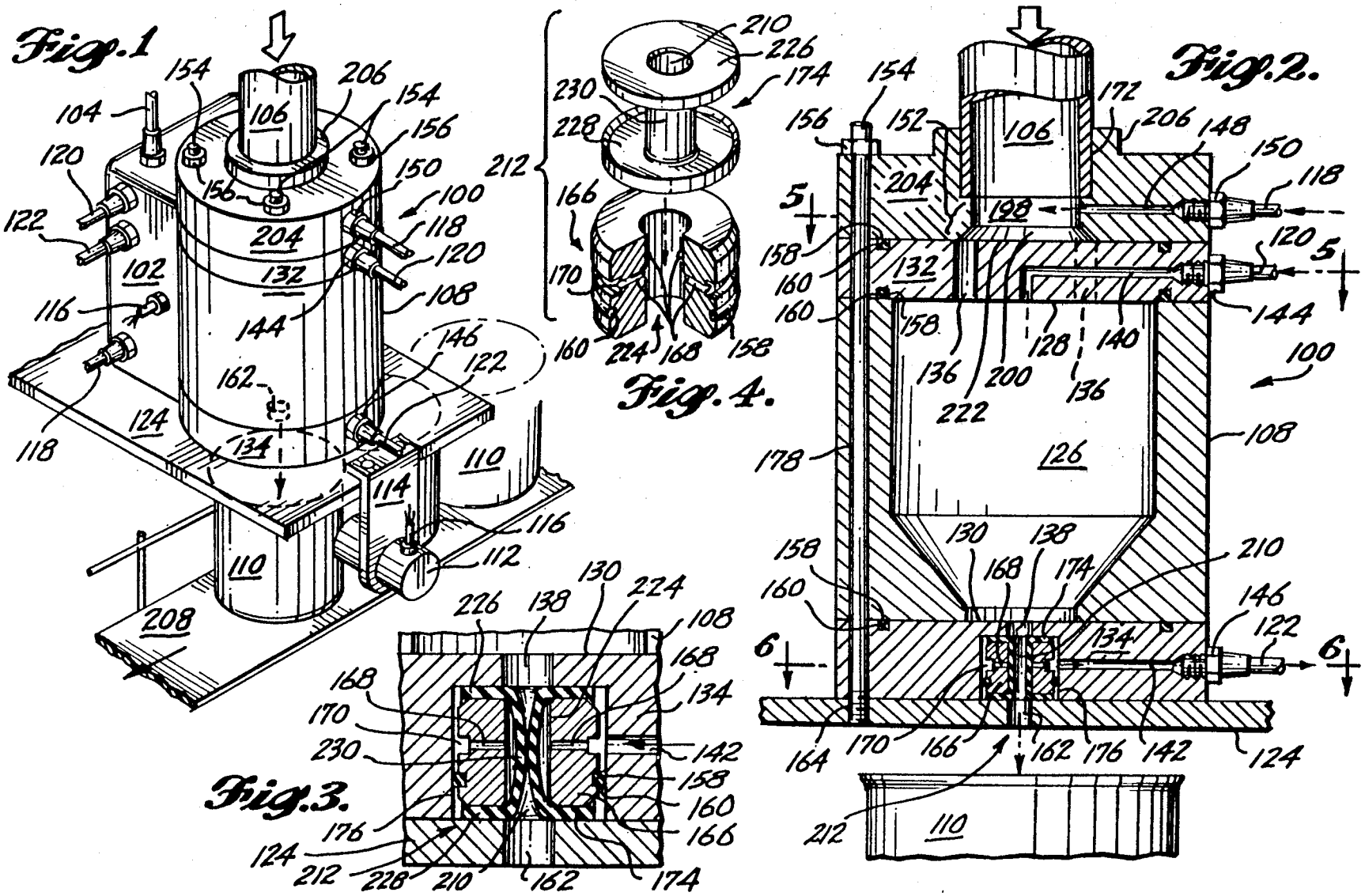
FIG. 1 is an isometric view of a dispenser apparatus formed in accordance with the present invention.
FIG. 2 is a vertical cross-sectional view of a dispenser apparatus formed in accordance with the present invention.
FIG. 3 is an enlarged view of the expandable valve assembly of the dispenser apparatus in FIG. 2.
FIG. 4 is an exploded isometric view of the expandable valve assembly of the dispenser apparatus in FIG. 2.

Referring to FIG. 1, a dispenser apparatus 100 formed in accordance with the present invention is useful in dispensing flowable materials such as chemicals, paint components, dyes, thickeners, solvents, resins, and granular materials into containers 110 that are continuously passed by the dispenser apparatus on a conveyor belt or other transport means generally indicated by reference numeral 208. The dispenser apparatus 100 is supported above the containers 110 by a base plate 124. The dispenser apparatus 100 formed in accordance with the present invention is particularly useful in dispensing granular flowable materials, such as salt, sugar, spices, sand, and the like, especially when small amounts of such granular flowable materials must be dispensed rapidly and accurately for extended periods of time. Generally such granular materials will have an average particle diameter similar to that of conventional table salt, although larger or smaller particles may also be dispensed. A preferred application relates to the dispensing of salt into one-half pound and one pound cans of canned fish, such as salmon. The preferred dimensions referred to hereinbelow are exemplary of a dispenser apparatus useful in the preferred application.

Referring to FIGS. 1 and 2, the dispenser apparatus 100 formed in accordance with the present invention includes an assembly of several individual elements. Although each of the elements is described hereinbelow individually, it is within the scope of the present invention that two or more of the individual elements may be combined into one integral element, incorporating the functions of each of the individual elements.

The individual elements making up a dispenser apparatus formed in accordance with the present invention include a housing 108 that includes a chamber 126, an inlet plate 132 that includes inlet ports 136 and an air conduit 140, a feed plate 204 that includes a feed conduit 152, a supply conduit 106, and an air conduit 148, and an outlet plate 134 that includes an expandable valve means generally indicated by reference numeral 212 and an air conduit 142. In assembled form, the outlet plate 134 is adjacent the base plate 124. Above the outlet plate 134 is the housing 108 followed by the inlet plate 132. The feed plate 204 is next and forms the top of the dispenser apparatus 100. The materials from which the elements of the dispenser apparatus 100 are machined should be moisture resistant in order to keep moisture out of the flowable material, particularly when the flowable material is a granular flowable material subject to caking and also to prevent oxidation of the dispenser apparatus when it is used in high humidity conditions. Each of the plates 132, 134, and 204 and housing 108 can be machined from a cylindrical rod of a plastic material. Although rods of other materials such as steel or iron can be used, it is preferred that an acrylic plastic material be used because of the moisture resistance and ease with which such plastic materials can be machined. Most preferably, the individual elements of the dispenser apparatus are machined from a clear, acrylic plastic rod having an outer diameter of about 4.0 inches that allows the operator to observe the operation of the dispenser apparatus.

Preferably, each of the individual elements (i.e., plates 132, 134 and 204 and housing 108) is machined from the same size rod, and accordingly has the same outer diameter. Each of the elements includes four bores 178 passing vertically through each element at positions offset by 90° around the periphery of the cylindrical elements. Each bore 178 receives a retaining bolt 154 having both ends threaded. The bolts 154 are passed through each element and one threaded end is received in threaded holes 164 in the base plate 124 that serves to support the dispenser apparatus 100 above the containers 110. The opposite end of the bolt 154 extends above the upper surface of the feed plate 204 and has a retaining nut 156 threaded thereon to provide a compressive force to secure the dispenser apparatus 100 to the base plate 124 and to maintain the vertical alignment of the individual elements. Although the individual elements have been described as being machined from a cylindrical rod, the present invention is not limited to such shape and the dispenser apparatus formed in accordance with the present invention may also be formed out of square rods and the like.

Supported on the exterior of the dispenser apparatus 100 is a control box 102. As will be described hereinbelow in more detail, the control box receives a supply of air through an air supply line 104. The control box 102 then regulates the air in response to a signal it receives on line 116 from an inductive sensor 112. The inductive sensor 112 is supported below the base plate 124 by a bracket 114 and serves to provide a signal to the control box 102 indicating the presence of a container 110 below the dispenser apparatus 100. After the signal is received, the dispensing cycle is initiated to dispense a predetermined quantity of flowable material into the container 110.

Referring primarily to FIG. 2, within the housing 108, is a chamber 126 that includes an inlet 128 at the top and an outlet 130 at the bottom for the flowable material. The chamber 126 is preferably cylindrical in shape with a truncated bottom. The upper portion of the chamber 126 has a constant diameter and the truncated bottom decreases in diameter from the upper constant diameter to the diameter of the outlet 130. The truncation of the bottom of the chamber 126 serves to direct the flowable material into the outlet. The outlet is generally one-half the diameter of the upper portion of the chamber 126. Preferably, in the context of a dispenser apparatus for dispensing salt into containers, the chamber 126 has a height of about 3.5 inches and an upper portion having a diameter of about 2.9 inches. The outlet 130 in the chamber 126 preferably has a diameter of about 1.25 inches.

Figure 5:
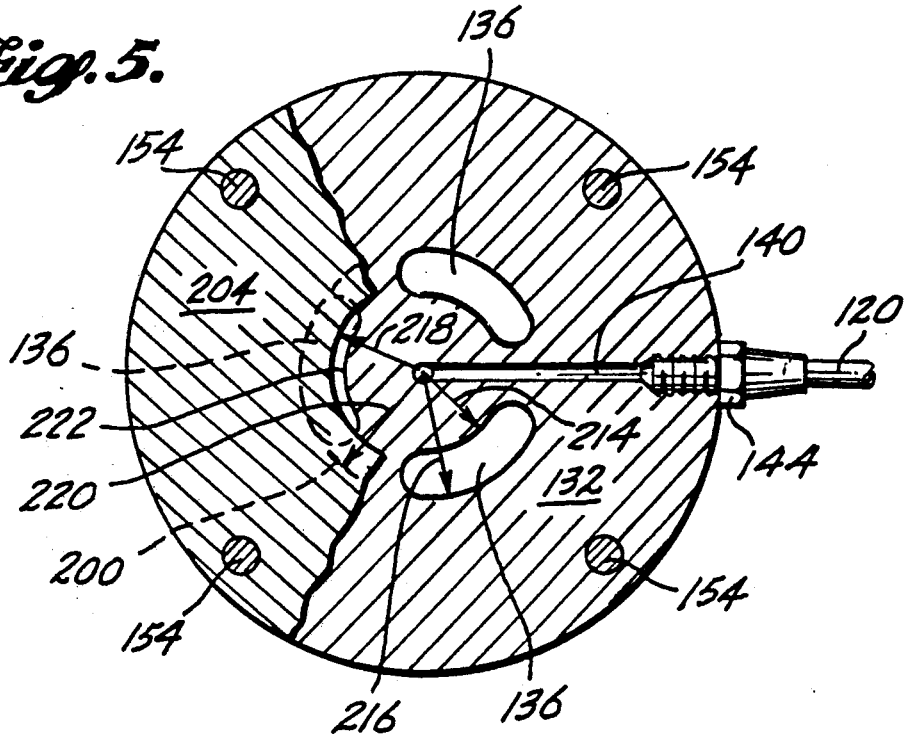
FIG. 5 is a horizontal cross-sectional view taken along line 5—5 of the dispenser apparatus in FIG. 2.

Above the chamber 126 is an inlet plate 132 that is preferably about 0.625 inches high. The inlet plate 132 includes at least one inlet port 136 that communicates with the inlet 128 to the chamber 126. The communication between the inlet port 136 and the inlet 128 allows the flowable material to pass through the inlet port 136 into the chamber 126. The lower surface of the inlet plate adjacent the inlet 128 includes a groove 160 around the periphery of the inlet plate just inside of the vertical bores 178. The groove 160 receives an O-ring 158 that provides a seal between the inlet plate 132 and the housing 108. The groove 160 and O-ring 158 have a diameter that is slightly larger than the constant diameter of the upper portion of the chamber 126. The upper surface of the inlet plate 132 includes a similar groove 160 having the same dimensions for receiving another O-ring 158 that provides a seal between the feed plate 204 and the inlet plate 132. Referring additionally to FIG. 5, the inlet ports 136 are in the shape of ellipses bowed inwardly towards the longitudinal axis of the dispenser apparatus 100. As shown in FIG. 5, although three equally spaced inlet ports 136 are preferred, additional inlet ports or fewer inlet ports may be equally applicable, depending on the particular flowable material being dispensed. The inlet ports 136 in the shape of inwardly bowed ellipses have longitudinal axes that are at a common radial distance D, preferably about 0.65 inches from the longitudinal axis of the dispenser apparatus. The inlet ports 136 have an inner boundary defining a radius $r_1$, preferably about 0.5 inches indicated by reference numeral 214, and an outer boundary defining a second radius $r_2$, preferably about 0.80 inches indicated by reference numeral 216. Each inlet port is preferably about 1.0 inches long. The portion of the inlet plate 132 inside of the first radius $r_1$ (214) defines a deflection plate 222 that serves to deflect the flowable material into the inlet ports 136 so that the flowable material may pass into the chamber 126 without caking and clogging the inlet port. The deflection of a flowable material by the deflection plate 222 is particularly important when the flowable material is a granular material that is subject to packing at the point where the material enters in the inlet ports 136.

In addition to the inlet ports 136 and the deflection plate 222, the inlet plate 132 includes an air conduit 140 that serves to provide pulses of pressurized air into the chamber 126 through the inlet 128 of the chamber. The air conduit 140 is a horizontal bore preferably having a diameter of about 0.07 inches, that passes through the inlet plate 132 to the axial center of the inlet plate where a 90° elbow directs the air conduit 140 downward into the inlet 128 of the chamber 126. Preferably, in order to insure that the air conduit 140 provides the pulses of pressurized air to the center of the chamber 126, the air conduit 140 must be such that it does not traverse the inlet ports 136 that pass vertically through the inlet plate 132. The air conduit 140 includes a conventional coupling 144 that connects the air conduit 140 to an air line 120 to be described in more detail hereinbelow. The balance of the inlet plate 132 is solid, and in cooperation with the O-rings 158, provides a sealed covering over the inlet 128 of the chamber 126.

Still referring to FIGS. 2 and 5, the lower portion of the feed plate 204 includes a feed conduit generally indicated by reference numeral 152. The feed conduit 152 includes a vertical bore, preferably about 0.25 inches long, that passes through a lower portion of the feed plate and defines a storage section 198. The storage section 198 has a radius $R_1$, preferably about 0.525 inches and generally indicated by reference numeral 218, that is substantially equal to the radius $r_1$ (214). The feed conduit 152 also includes a truncated bore concentrically positioned below the storage section 198 that has a primary radius $R_1$ (218) that increases to a secondary radius $R_2$, preferably about 0.80 inches and indicated by reference numeral 220 that is substantially equal to the radius $r_2$ (216). The truncated bore defines a feed section 200 below the storage section 198. Thus, the feed conduit 152 includes a storage section 198 that provides flowable material to a feed section 200 that has a radius that increases from the radius of the storage section 198 to the radius of the outer boundary of the inlet ports 136.

Also within the feed plate 204 is an air conduit 148 for providing pressurized air to the feed conduit 152. The air conduit 148 is similar to the air conduit 140 in the inlet plate 132 and includes a horizontal bore passing through the feed plate 204 and into the feed conduit 152. The air conduit 148 is provided with a conventional coupling 150 for providing a connection to air line 118 that is described in more detail hereinbelow. The air conduit 148 preferably enters the feed conduit 152 in the storage section 198.

The top of the feed conduit 152 is recessed in the top of the feed plate 204. Above the feed conduit 152 is another bore 172 having a radius slightly larger than the radius $R_1$ (218) of the storage section 198 of the feed conduit 152. The slightly larger diameter of the bore 172 above the feed conduit 152 is preferably about 1.3 inches and provides a secure fitting for a supply conduit 106 that includes a cylindrical tube having an inner radius substantially equal to the radius $R_1$ (218) of the storage section 198. The supply conduit has an outer radius that allows the supply conduit 106 to fit snugly into the bore 172 above the storage section 198. The top of the feed plate 204 includes a reinforcing neck 206 that serves to provide additional support to the supply conduit 106. The supply conduit 106 may be a rigid or a flexible tube. The supply conduit 106 communicates between a hopper 300 in FIG. 8 and the storage section 198 of the feed conduit 152 and provides a passageway for the flowable material from the hopper to the feed conduit 152.

In the context of dispensing a granular flowable material, such as salt, the supply conduit 106 should be vertically oriented and have a length of at least three feet when the radius of the supply conduit 106 is about 0.5 inches. A length of three feet is preferred, because above three feet it has been found that the pressure at the bottom of the supply conduit 106 and feed conduit 152 is not affected to any great degree by the height of the granular material in the supply conduit 106. Thus by providing a height of at least three feet of the flowable granular material, it is possible to provide a substantially constant pressure or head at the bottom of the feed conduit 152 and supply conduit 106. Naturally, the minimum height of flowable material in the supply conduit 106 can be adjusted depending on the particular granular material, the diameter of the supply conduit 106, and the constant pressure desired at the bottom of the feed conduit 152 and supply conduit 106. Because the pressure in the dispenser apparatus affects the amount of flowable material to be dispensed, a constant pressure is preferred so that accurately reproducible amounts are dispensed. When dispensing fluid and viscous materials as opposed to granular materials, the pressure at the bottom of the feed conduit 152 can be maintained constant by maintaining a pressurized, sealed environment within the dispenser apparatus. This could include sealing the hopper and keeping a constant volume of material in the hopper. Another alternative would be to pressurize the chamber 126 and maintain an air lock between the chamber and the feed conduit 152. Another method of maintaining a viscous material at a constant pressure for dispensing in accordance with the present invention is illustrated in FIGS. 9, 13, 14, and 15 of applicant's U.S. Pat. No. 4,789,016, which is incorporated by reference herein in its entirety.

Figure 6:
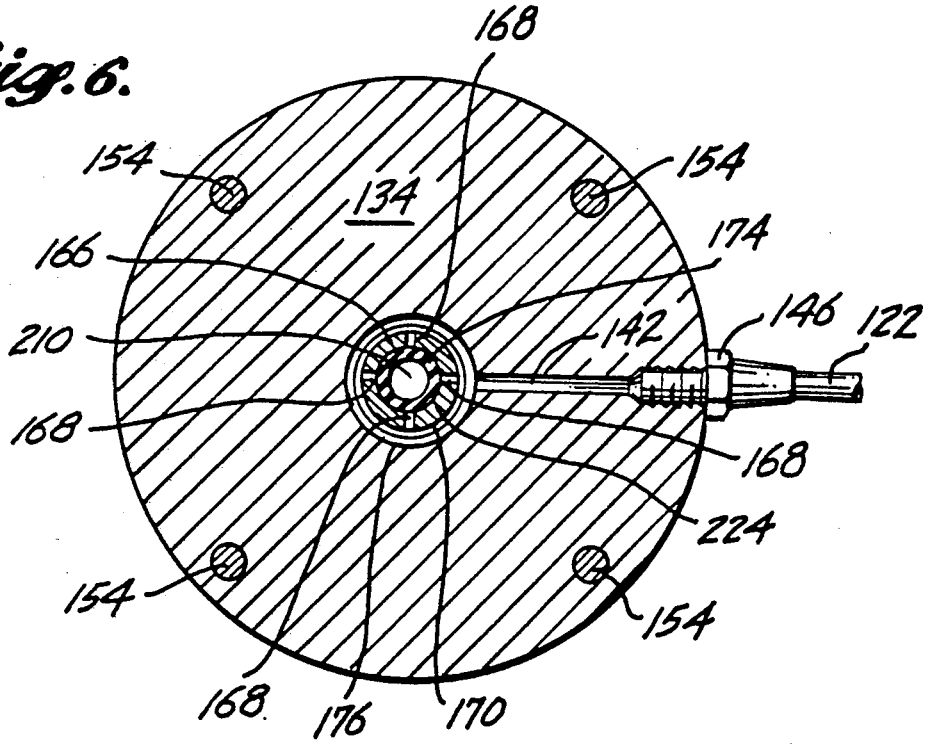
FIG. 6 is a horizontal cross-sectional view taken along line 6—6 of the dispenser apparatus of FIG. 2.

Referring to FIGS. 2 and 6, below the chamber 126 and housing 108 is an outlet plate 134, preferably having a height of about 1.0 inch. Centered in the upper surface of the outlet plate 134 is a bore passing through an upper portion of the outlet plate 134, defining an outlet conduit 138. The outlet conduit 138 communicates with the outlet 130 of the chamber 126. The outlet conduit preferably has a diameter of about 0.25 inches and is about 0.125 inches long. Below the outlet conduit 138 is another bore of larger diameter that defines a valve cup 176. The valve cup 176 preferably has a diameter of about 0.75 inches and extends through the balance of the outlet plate 134 and communicates between the outlet conduit 138 and the exterior of the outlet plate 134 adjacent the base plate 124. As will be described in more detail hereinbelow, the valve cup 176 receives an expandable valve means 212 that intermittently permits the flowable material to pass through the outlet conduit 138 and valve cup 176 and finally through a vertical bore 162 in the horizontal base plate 124. The outlet plate 134 also includes a horizontal bore similar to those described above that defines an air conduit 142 for providing pressurized air to the valve cup 176. The air conduit 142 is provided with a conventional coupling 146 for providing connection to an air line 122. The top of the outlet plate 134 includes a groove 158 adjacent the periphery of the outlet plate 134 just inside the retaining bolts 154 for receiving an O-ring 160 that provides a seal between the outlet plate 134 and the housing 108.

Referring to FIGS. 2, 3, and 4, the expandable valve means 212 includes a solid plastic or metal valve spool 166, and an expandable valve member 174. The valve spool 166 includes a solid rod having an outer diameter substantially equivalent to the diameter of the valve cup 176, such that the valve spool 166 can slide into and be securely seated within the valve cup 176. Preferably, the valve spool has an outer diameter of about 0.75 inches. The height of the valve spool 166 is slightly less than the depth of the valve cup 176 by an amount substantially equivalent to the combined thickness of the flanges 226 and 228 of expandable valve member 174. Preferably, the valve spool is about 0.85 inches high. Because the valve spool 166 is not quite as high as the valve cup 176 is deep, clearance is provided so that the flanges 226 and 228 of the expandable valve member 174 can be compressed between the base plate 124 and the valve spool 166 and the top of the valve cup 176 and the valve spool 166, thus providing an airtight seal between the base plate 124 and the bottom of the valve spool 166 and the outlet plate 134 and the top of the valve spool 166. The valve spool 166 is preferably plastic and includes a longitudinal vertical bore 224 passing through the cylindrical valve spool 166 along the longitudinal axis of the valve spool. The bore 224 preferably has a diameter of about 0.28 inches. Around the periphery of the valve spool 166 about halfway up in a horizontal plane is an air distribution/collector ring 170 that includes a groove, preferably about 0.125 inches wide machined preferably about 0.03 inches into the periphery of the valve spool 166. Four horizontal bores 168 pass horizontally from the base of the groove 170 into the central vertical bore 224. The four bores 168 preferable have a diameter of about 0.0625 inches and provide a means of introducing and venting pressurized air into and out of the central bore 224 of the valve spool 166. The four bores 168 are each offset 90° from each other. Below the air distribution/collector ring 170 is a shallower groove 160 passing around the periphery of the valve spool 166 in a horizontal plane. The groove 160 receives an O-ring 158 that provides an airtight seal between the valve spool 166 and the outlet plate 134 below the air distribution/collector ring 170. The outer edge of the upper and lower ends of the valve spool 166 are beveled at 45°.

The expandable valve member 174 includes a rubber or other elastic element capable of being repeatedly expanded and contracted into a relaxed position. The expandable valve member 174 includes a body comprising a vertical cylinder 230 with horizontal flanges 226 and 228 at the top and the bottom of of the cylinder. The outer diameter of the vertical cylinder 230 is such that the cylinder 230 will fit snugly within the vertical bore 224 that passes through the valve spool 166. The length of the cylinder 230, and accordingly, the spacing between the horizontal flanges 226 and 228 is substantially equivalent to the height of the valve spool 166. Accordingly, the horizontal flanges 226 and 228 extend over the top and bottom of the valve spool 166 when the cylinder 230 is received in the bore 224. The outer periphery of the flanges 226 and 228 include an overhanging lip that serves to cradle around the beveled edges of the valve spool 166. The cradling of the beveled edges by the lip serves to prevent the flanges 226 and 228 from pulling away from the valve spool 166 when the expandable valve member 174 is expanded as described in more detail hereinbelow.

The expandable valve member 174 is formed by a vulcanizing process that imparts strength and elasticity to a latex rubber or other type of natural rubber or synthetic rubber. Latex rubber is preferred when the flowable material is oil-free. If flowable materials at elevated temperatures are to be dispensed, silicon rubbers are preferred. If the flowable material contains oils, a synthetic rubber such as BUNA N TM elastomer available from Bunawerke Huls is preferred. The expandable valve members are made by wrapping techniques similar to those employed in the art of manufacturing pinch valves. The expandable valve member 174 must exhibit a balance of resistance to abrasion and puncturing and an elastic memory that causes the valve member to quickly return to its relaxed state.

The expandable valve means 212 comprises the valve spool 166 with the expandable valve member 174 positioned within the vertical bore 224 passing through the valve spool 166. Because the expandable valve member 174 is slightly longer than the depth of the valve cup 176, when the expandable valve means 212 is placed in the valve cup 176 and the outlet plate 134 is securely fastened to the base plate 124, the compressive force between the top of the valve cup 176 and the base plate 124 compresses the flanges 226 and 228 and provides two airtight seals, one between the base plate 124 and the bottom of the valve spool 166 and one between the outlet plate 134 and the top of the valve spool 166. In order to insure the integrity of the air tight seals, lubricating means such as petroleum jelly or other types of sealants may be applied to the expandable valve member 174 prior to inserting the expandable valve means 212 into the valve cup 176.

The bore 210 passing through the center of the expandable valve member 174 provides a passageway for the flowable material to pass from the outlet conduit 138 through the expandable valve member 174 and through the bore 162 in the base plate 124. The air distribution/collector ring 170 is positioned adjacent to the air conduit 142 so that it can receive pressurized air through the air conduit 142 and distribute it to the horizontal bores 168 in the valve spool 166. The air conduits 168 serve to provide the pressurized air to the relaxed expandable valve member 174 which causes the expandable valve member 174 to expand and close the bore 210, thus preventing the flowable material from exiting the chamber 126 through the outlet conduit 138. In order to allow the flowable material to pass through the outlet conduit 138 and through the bore 210, the pressurized air in line 142 is vented through line 122 and the expandable valve member 174 is allowed to contract to a relaxed position, thus opening the bore 210. Although the present invention is illustrated as only employing one expandable valve means 212, more than one expandable valve means 212 may be employed with slight modification of the outlet plate 134.

Figure 7:
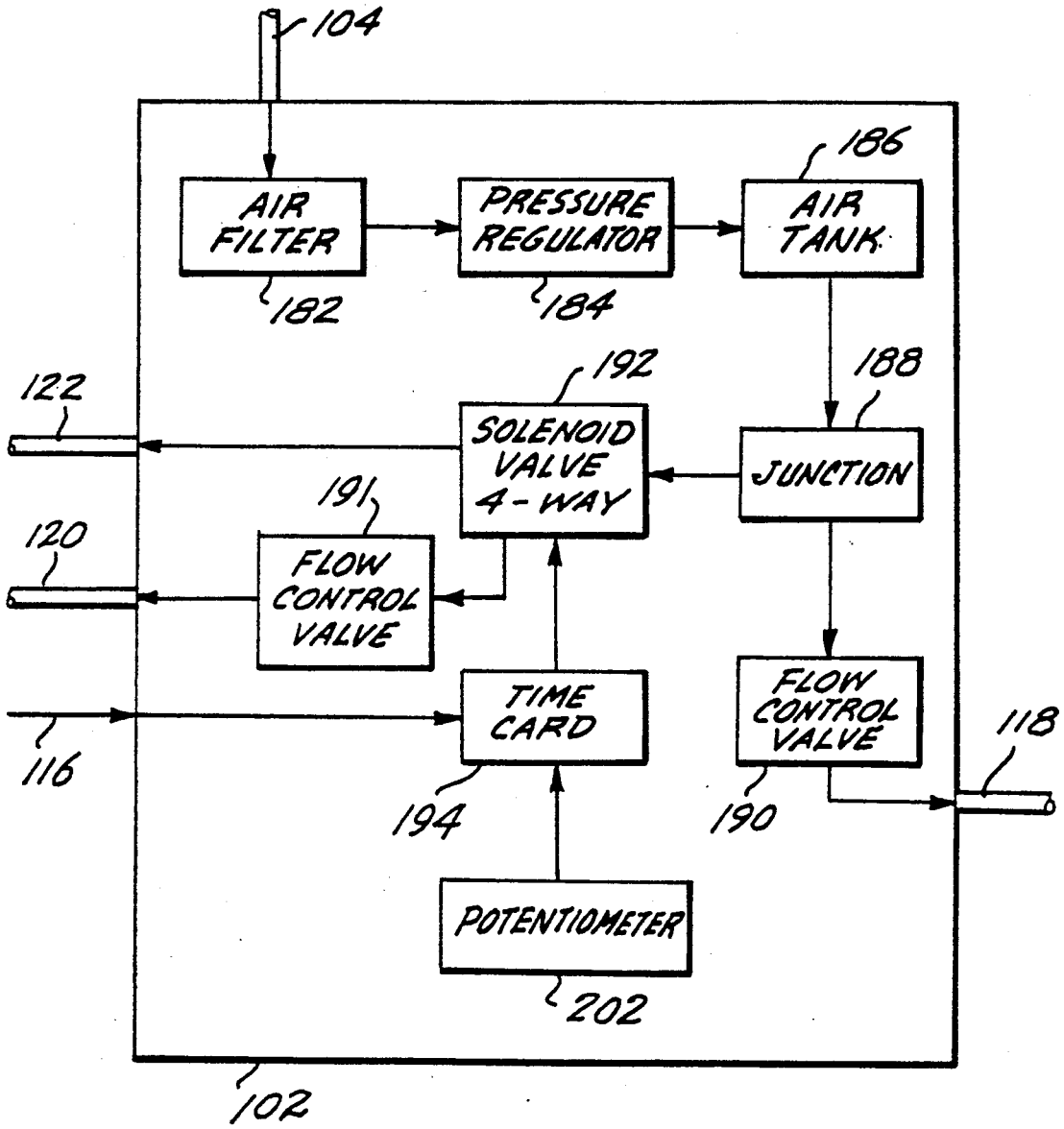
FIG. 7 is a block diagram of an air control system for the dispenser apparatus formed in accordance with the present invention.

Referring to FIGS. 1 and 7, the operation of a dispenser apparatus formed in accordance with the present invention is controlled by conventional means contained within a control box 102 that can be attached to or be remote from the dispenser apparatus 100. The control box 102 receives pressurized air through an air supply line 104. The air is filtered by an air filter 182 to remove impurities and moisture. The dehumidified and purified air is then passed through a pressure regulator 184 to maintain a constant pressure, preferably about 45 psi when a granular flowable material such as salt is being dispensed and the expandable valve member 174 is made from the preferred latex rubber described above having the preferred dimensions described above. From the pressure regulator 184, the air passes into a storage tank 186 where it is collected and then passed to a junction 188. The junction 188 splits the pressurized air stream into two individual streams. One stream is metered through a flow control valve 190 and then into air line 118 that is connected to air conduit 148 in the feed plate 204. The air from line 118 passes through the air conduit 148 into the storage section 198 of the feed conduit 152. A portion of the pressurized air from conduit 148 passes upward through the granular flowable material in the supply conduit 106 and ultimately into and out of the hopper 300 in FIG. 8 that is vented to the atmosphere. Because the pressurized air is dehumidified and provides a positive pressure in the hopper 300 in FIG. 8, supply conduit and feed conduit, it serves to prevent the granular material from being contaminated by ambient moisture that may cause the granular flowable material to cake and pack, thus clogging the passageways in a dispenser apparatus formed in accordance with the present invention. Although the air in line 148 is preferably pressurized to about 45 psi, once it enters the storage section 198 of the feed conduit 152, the pressure drops to about 1 psi because the feed conduit 152 is ultimately vented to the atmosphere through the supply conduit 106 and hopper 300 in FIG. 8. Although the pressurized air in line 148 is preferred when dispensing granular flowable material, when dispensing fluids, it may not be necessary to provide such pressurized air because caking due to moisture absorption will not be a major concern. In fact with certain fluids, it may even be undesirable to provide such pressurized air.

The other line out of the two-way junction 188 is directed to a four-way solenoid valve 192 that splits the air stream into two separate streams that supply pressurized air to lines 122 and 120. A flow control valve 191 controls the magnitude of the flow of pressurized air into line 120. The solenoid valve is designed so that when pressurized air is directed into line 122, line 120 is vented and vice versa when line 122 is being vented, pressurized air is directed into line 120. The solenoid valve 192 is controlled by conventional means such as a time card 194 in cooperation with a potentiometer 202. When the inductive sensor 112 in FIG. 1 senses a container 110 in FIG. 1, it directs a signal to the time card on line 116 and in conjunction with the potentiometer 202 shifts the solenoid valve 192 into the appropriate position. In the context of the dispenser apparatus shown in FIG. 1, the solenoid valve 192, time card 194 and potentiometer 202 should cooperate such that when the inductive sensor 112 detects a container 110 and provides a signal on line 116, pressurized air in line 122 is vented so that the expandable valve member 174 relaxes and opens. When the pressurized air in line 122 is vented, pressurized air is directed through flow control valve 191 into line 120 which provides a pulse of pressurized air into the chamber 126. The pulse of pressurized air and gravity provide the driving force that will direct the flowable material through the outlet conduit 138 into passageway 210 through the bore 162 in the base plate and into container 110. The time card 194 and potentiometer 202 can be adjusted such that the period of time over which the line 122 is vented and the expandable valve means allowed to relax is determined based on the amount of flowable material that is preferably dispensed by the dispenser apparatus into the container. The specific gravity of the flowable material, the pressure of the pressurized air, the size of the passageway in the expandable valve member and the speed with which the expandable valve member returns to a relaxed position are all additional considerations in determining the period of time required to dispense a predetermined quantity of the flowable material. At the end of the cycle, the solenoid valve will return to the initial position so that the pressurized air in line 120 is vented while pressurized air is again directed into line 122 to expand the expandable valve member 174 and close off the passageway 210. It should be understood that the venting of the pressurized air in line 122 will not be initiated again until the inductive sensor 112 detects another container 110. As a means of process control and monitoring it may be desirable to provide the potentiometer 202 with an override circuit that will either provide the signal necessary to complete one cycle or a complete override circuit that will allow the expandable valve means 174 to be opened for a period of time at the discretion of the operator.

In certain instances, it may not be necessary to provide the pulse of pressurized air to the chamber 126. This will be true when the pressure at the outlet conduit 138 provided by the weight of the flowable material is a sufficient driving force to provide the desired quantity in the required period of time. Generally, the smaller the desired quantity and the longer the period of time available to dispense the desired quantity, the less need for the pulses of pressurized air. When the pulses of pressurized air are provided, the magnitude of the pulse should not be so great so as to cause the flowable material to be driven into the container with such force that it is deflected out of the container. The magnitude of the pulses can be controlled by control valve 191 in FIG. 7.

Figure 8:
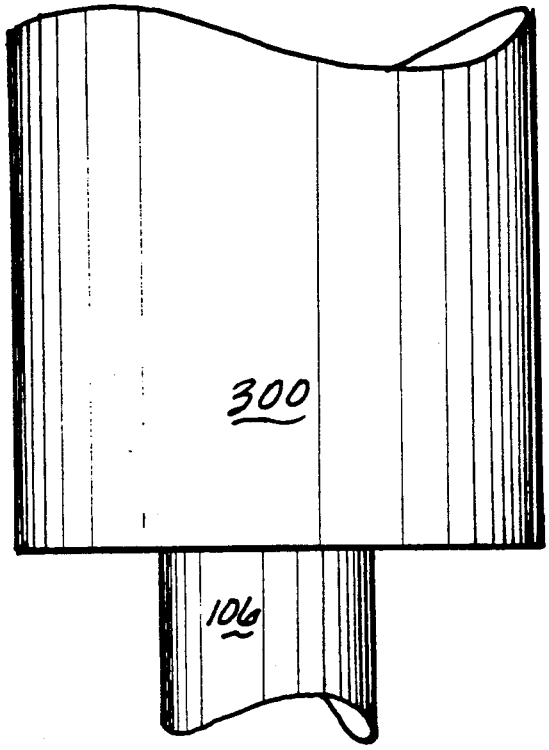
FIG. 8 is a schematic view of a hopper useful in accordance with the present invention.

Referring primarily to FIG. 2, the flowable material to be dispensed by a dispenser apparatus 100 formed in accordance with the present invention passes from a hopper 300 in FIG. 8 via the supply conduit 106 into the storage section 198 of the feed conduit 152. From the storage section 198 of the feed conduit 152, the flowable material passes into the feed section 200 of the feed conduit 152 and is spread out by the deflection plate 222 so that it will be passed into the inlet ports 136. The inlet ports 136 provide a passage for the flowable material into the chamber 126 which is constantly full of the flowable material because of the constant supply. The flowable material in the chamber 126 then passes out the outlet 130 into outlet conduit 138 and then through passageway 120 into the bore 162 in the base plate and finally into the container 110 that is passed below. Because of the resiliency of the preferred expandable valve member 174 and the speed at which the pulses of air can be provided, the dispenser apparatus 100 formed in accordance with the present invention, can dispense quantities of granular flowable materials such as salt and the like in accurate amounts, for example 25 grains, at rates ranging up to at least 500 times per minute and preferably at least about 600 times per minute. Larger amounts, for example about 50 grains, can be dispensed at rates of at least about 400 times per minute. The amounts are merely exemplary of the quantities of granular flowable materials that can be dispensed by a dispenser apparatus formed in accordance with the present invention. Other amounts and speeds can be achieved in accordance with the present invention.

While the present invention has been described in relation to a preferred embodiment, it is to be understood that various alterations, substitutions of equivalents or other changes can be made without departing from the spirit and scope of the present invention. For example, the apparatus formed in accordance with the present invention can be utilized to dispense fluid, viscous, or granular materials that are flowable. Additional examples of flowable materials include oil, water, tomato paste, ground meats, jellies, jams, and syrups. The pressurized air can also be other inert pressurized gases and may be provided from independent sources so long as they are synchronized as described above. Furthermore, more than one expandable valve means can be provided on a single dispenser apparatus formed in accordance with the present invention. Finally, other pressures and periods of time for expanding and contracting the expandable valve member may be utilized depending on the particular type of flowable material being dispensed and the desired amounts to be dispensed. It is therefore intended that the scope of Letters Patent granted herein will be limited only by the definition contained in the appended claims and equivalents thereof.

The embodiments of the invention in which an exclusive property or privilege is claimed are defined as follows:

1. A dispenser apparatus for dispensing a predetermined quantity of a flowable material, said apparatus comprising:

(a) a feed conduit for providing said flowable material from a primary source, said primary source including a supply conduit and a hopper, said supply conduit communicating between said hopper and said feed conduit, said hopper being vented to the atmosphere;

(b) a chamber having an inlet and an outlet;

(c) at least one inlet port passing through an inlet plate and communicating between said feed conduit and said chamber inlet;

(d) first means for providing pulses of pressurized gas to said chamber;

(e) second means for providing pressurized gas to said feed conduit;

(f) an outlet port communicating with said chamber outlet; and (g) an expandable valve means disposed within said outlet port for intermittently permitting said flowable material to pass through said outlet port.

2. The dispenser apparatus of claim 1, wherein said expandable valve means expands to prevent the flow of said flowable material from said chamber and contracts to allow the flow of said flowable material from said chamber.

3. The dispenser apparatus of claim 1, wherein said expandable valve means expands in response to the application of pressurized gas to said expandable valve means and contracts in response to the removal of said pressurized gas from said expandable valve means.

4. The dispenser apparatus of claim 3, wherein said first means provides a pulse of pressurized gas to said chamber in synchronization with said contraction of said expandable valve means.

5. The dispenser apparatus of claim 1, wherein said primary source of said flowable material is maintained at a pressure less than 1.0 psi.

6. The dispenser apparatus of claim 1, wherein said inlet port is shaped as an ellipse bowed inwardly, the longitudinal axis of said ellipse being at a common radial distance D from the longitudinal axis of said dispenser apparatus, said inlet port having an inner boundary defining a first radius $r_1$ from said longitudinal axis of said dispenser apparatus, and an outer boundary defining a second radius $r_2$ from said longitudinal axis of said dispenser apparatus , $r_1$ being less than $r_2$.

7. The dispenser apparatus of claim 6, wherein said feed conduit includes a storage section and a feed section positioned below said storage section, said storage section having a radius $R_1$ and said feed section having a radius that increases from $R_1$ to $R_2$, wherein $R_2$ is substantially equal to $r_2$ and $R_1$ is substantially equal to $r_1$.

8. The dispenser apparatus of claim 1, wherein a portion of said inlet plate deflects said flowable material in said feed conduit into said inlet port.

9. The dispenser apparatus of claim 8, wherein said inlet plate deflecting portion defines the inner boundary of said inlet port.

10. The dispenser apparatus of claim 1, wherein said expandable valve means is capable of being expanded and contracted at least 500 times per minute by intermittently introducing pressurized gas into said expandable valve means.

11. The dispenser apparatus of claim 1, wherein said flowable material is a granular material.

12. The dispenser apparatus of claim 11, wherein said granular material is salt.

13. The dispenser apparatus of claim 11, wherein said primary source of flowable material receives pressurized gas, said pressurized gas entering said primary source of flowable material such that a portion of said pressurized gas passes through said flowable material in a direction opposite to the direction said flowable material is flowing.

14. A dispenser apparatus for dispensing a predetermined quantity of a flowable material, said apparatus comprising:

(a) a chamber having an inlet and an outlet;
(b) an inlet plate adjacent said chamber inlet, a plurality of inlet ports passing through said inlet plate and communicating with said chamber inlet;
(c) a feed conduit for providing said flowable material to said inlet ports;
(d) first means for providing pulses of pressurized gas to said chamber;
(e) second means for providing pressurized gas to said feed conduit;
(f) an outlet plate adjacent said chamber outlet, said outlet plate including an outlet port communicating with said outlet;
(g) an expandable valve means disposed within said outlet port for intermittently permitting said flowable material to pass through said outlet port; and
(h) a supply conduit communicating between said feed conduit and a hopper.

15. The dispenser apparatus of claim 14, wherein said supply conduit is a vertical cylinder and is at least about three feet high.

16. The dispenser apparatus of claim 14, wherein said expandable valve means expands to prevent the flow of said flowable material from said chamber and contracts to allow the flow of said flowable material from said chamber.

17. The dispenser apparatus of claim 14, wherein said expandable valve means expands in response to the application of pressurized gas to said expandable valve means and contracts in response to the removal of said pressurized gas from said expandable valve means.

18. The dispenser apparatus of claim 17, wherein said first means provides a pulse of pressurized gas to said chamber in synchronization with said contraction of said expandable valve means.

19. The dispenser apparatus of claim 14, wherein said supply conduit and hopper are maintained at a pressure less than 1.0 psi.

20. The dispenser apparatus of claim 14, wherein said inlet ports are shaped as an ellipse bowed inwardly, the longitudinal axis of said ellipse being at a common radial distance D from the longitudinal axis of said dispenser apparatus, said inlet ports having an inner boundary defining a first radius $r_1$ from said longitudinal axis of said dispenser apparatus, and an outer boundary defining a second radius $r_2$ from said longitudinal axis of said dispenser apparatus, $r_1$ being less than $r_2$.

21. The dispenser apparatus of claim 20, wherein said feed conduit includes a storage section and a feed section positioned below said storage section, said storage section having a radius $R_1$ and said feed section having a radius that increases from $R_1$ to $R_2$, wherein $R_2$ is substantially equal to $r_2$ and $R_1$ is substantially equal to $r_1$.

22. The dispenser apparatus of claim 14, wherein a portion of said inlet plate deflects said flowable material in said feed conduit into said inlet port.

23. The dispenser apparatus of claim 22, wherein said inlet plate deflecting portion defines the inner boundary of said inlet port.

24. The dispenser apparatus of claim 14, wherein said expandable valve means is capable of being expanded and contracted at least 500 times per minute by intermittently introducing pressurized gas into said expandable valve means.

25. The dispenser apparatus of claim 14, wherein said flowable material is a granular material.

26. The dispenser apparatus of claim 25, wherein said granular material is salt.

27. The dispenser apparatus of claim 25, wherein said feed conduit receives pressurized gas, said pressurized gas entering said feed conduit such that a portion of said pressurized gas passes through said flowable granular material in a direction opposite to the direction said granular material is flowing.

* * * * *

UNITED STATES PATENT AND TRADEMARK OFFICE

CERTIFICATE OF CORRECTION

PATENT NO. : 5,012,957

DATED : May 7, 1991

INVENTOR(S) : Stavros Mihail

It is certified that error appears in the above-identified patent and that said Letters Patent is hereby corrected as shown below:

| Column | Line | |
|---|---|---|
| 2 | 28 | "appartus" should be --apparatus-- |
| 2 | 55 | "value" should be --valve-- |
| 12 | 48 | "apparatus , $r_1$" should be --apparatus, $r_1$-- |

Signed and Sealed this

Fifth Day of January, 1993

*Attest:*

*Attesting Officer*

DOUGLAS B. COMER

*Acting Commissioner of Patents and Trademarks*